US006325745B1

(12) United States Patent
Yu

(10) Patent No.: US 6,325,745 B1
(45) Date of Patent: Dec. 4, 2001

(54) FOLDABLE JOGGING MACHINE HAVING A TROTTING PLATFORM THAT CAN BE ERECTED

(76) Inventor: Jessica Yu, 1F, No. 1, Lane 50, Sec. 1, Chung San N. Rd., Yang Mei Chen, Taoyuan Hisien (TW)

( * ) Notice: Subject to any disclaimer, the term of this patent is extended or adjusted under 35 U.S.C. 154(b) by 0 days.

(21) Appl. No.: 09/595,021

(22) Filed: Jun. 16, 2000

(30) Foreign Application Priority Data

Apr. 26, 2000 (TW) ..... 89207039 U

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 6,033,347 * 3/2000 Dalebout et al. ..... 482/54
6,050,923 4/2000 Yu .

* cited by examiner

*Primary Examiner*—Glenn E. Richman
(74) *Attorney, Agent, or Firm*—Browdy and Neimark

(57) ABSTRACT

A foldable jogging machine comprises a base, a trotting platform, a support device, and a linear actuator. The base is formed of a left side and a right side. The trotting platform is supported by the support device comprising a left support rod and a right support rod. The support device is mounted on the base such that one end of the left support rod is slidably received in a left slotted rail of the left side of the base, and that one end of the right support rod is slidably received in a right slotted rail of the right side of the base. The linear actuator is fastened with the trotting platform in such a way that an expandable rod of the linear actuator is fastened pivotally with the support device. The trotting platform can be either slanted or erected.

4 Claims, 6 Drawing Sheets

FOLDABLE JOGGING MACHINE HAVING A TROTTING PLATFORM THAT CAN BE ERECTED

FIELD OF THE INVENTION

The present invention relates generally to a jogging machine, and more particularly to a foldable jogging machine which is provided with a trotting platform capable of being set in an upright position to facilitate the storage of the jogging machine.

BACKGROUND OF THE INVENTION

The conventional electric jogging machine comprises a support frame and a trotting platform. The support frame is formed of a base and a support body extending upward from the base. The two opposite sides of the front end of the trotting platform are fastened pivotally with the support body. The underside of the rear end of the trotting platform is provided with two feet in contact with the floor surface. The conventional jogging machine is folded by lifting the rear end of the trotting platform, which is then turned on the two pivoting points of the front end of the trotting platform to join with the support body. The center of gravity of the conventional electric jogging machine is relatively high in view of the two pivoting points being apart from the floor surface by a considerable distance. As a result, the jogging machine in operation is apt to sway, thereby making its user uneasy and jittery. In addition, the trotting platform is manually slanted to accommodate its user to emulate an uphill jogging. The manual adjustment of the trotting platform is conceivably inconvenient to its user who is in the midst of doing the jogging exercise.

The U.S. Pat. No. 6,050,923 discloses a foldable jogging machine, which is free from the shortcomings of the conventional electric jogging machine described above and is formed of a trotting platform and a triangular support mechanism for supporting the trotting platform. This prior art jogging machine is defective in design in that its trotting platform is considerably heavy and is therefore susceptible to vacillation.

SUMMARY OF THE INVENTION

It is the primary objective of the present invention to provide a foldable jogging machine which has a relatively low center of gravity and is therefore stable while in operation.

It is another objective of the present invention to provide a foldable jogging machine which has a trotting platform capable of being slanted at any time to accommodate its user to emulate an uphill jogging.

It is still another objective of the present invention to provide a foldable jogging machine with a support device for stabilizing effectively the foldable jogging machine.

It is still another objective of the present invention to provide a foldable jogging machine with a trotting platform which can be erected with ease and speed.

In keeping with the principle of the present invention, the foregoing objectives of the present invention are attained by the foldable jogging machine comprising a base, a trotting platform, a support device, and a linear actuator. The base is rested on the floor surface and is formed of a left side having a left slotted rail, and a right side opposite to the left side and having a right slotted rail. The trotting platform is supported by the support device on the base such that the trotting platform can be folded and unfolded. The support device comprises a left support rod and a right support rod. The support device is mounted on the base such that one end of the left support rod is capable of sliding along the left slotted rail of the base, and that one end of the right support rod is capable of sliding along the right slotted rail of the base. The linear actuator is fastened with a carrying plate of the trotting platform such that the free end of an expandable rod of the linear actuator is pivoted with the support device, thereby enabling the front side of the trotting platform to be raised so as to set the trotting platform in an inclined position to accommodate the user of the jogging machine to engage in an uphill jogging.

DETAILED DESCRIPTION OF THE INVENTION

Figure 1:
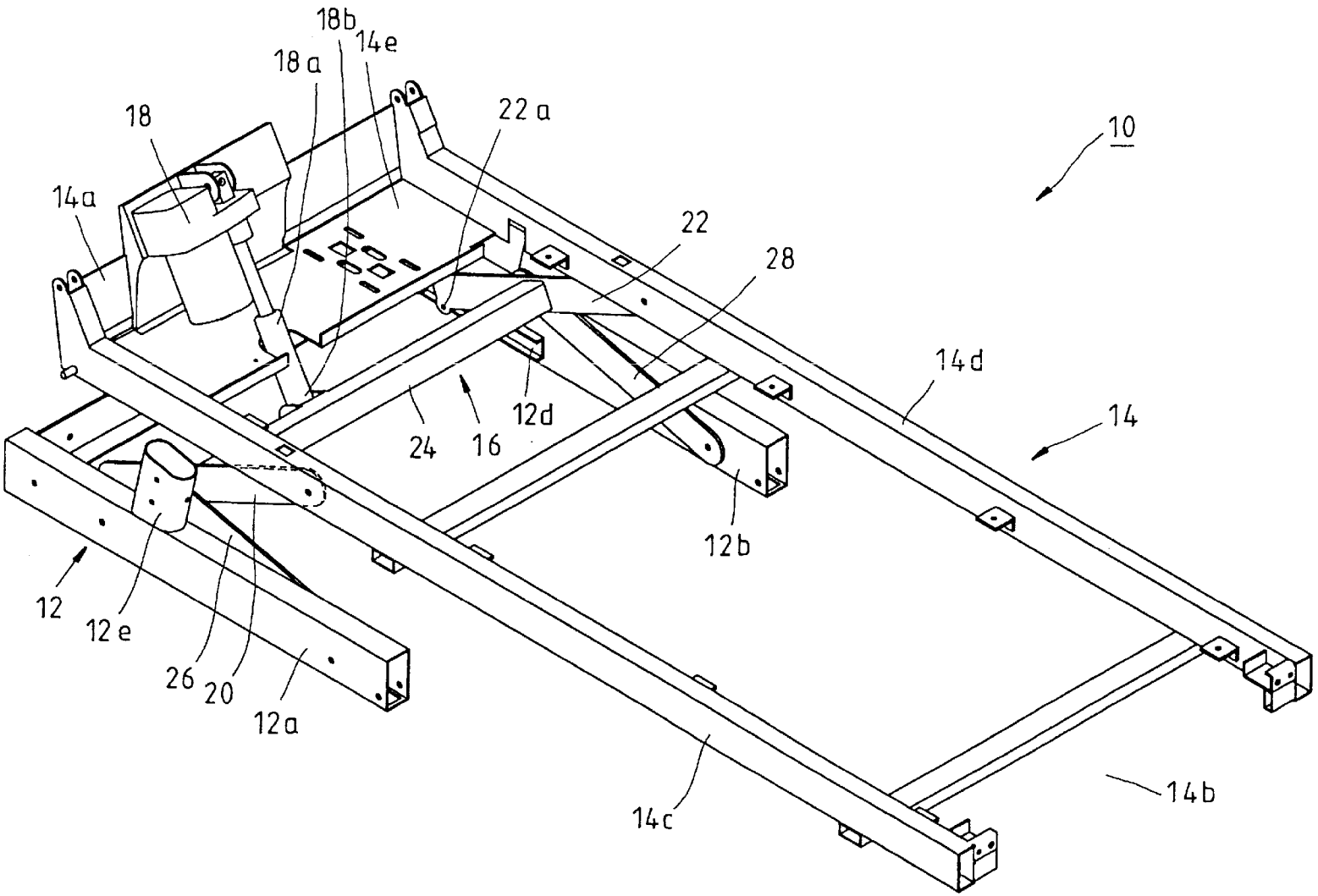
FIG. 1 shows a perspective view of the present invention with the trotting platform thereof being set in an inclined position.

As shown in all drawings provided herewith, a foldable jogging machine 10 embodied in the present invention is formed of a base 12, a trotting platform 14, a support device 16, and a linear actuator 18.

The base 12 is formed of metal rods, which are joined together by soldering. The base 12 is formed of a left side 12*a* having a left slotted rail 12*c*, and a right side 12*b* opposite to the left side 12*a* at an interval and having a right slotted rail 12*d*. The left and the right sides 12*a* and 12*b* are respectively provided with a left tubular body 12*e*, a right tubular body 12*f*, which are intended for fastening two handles (not shown in the drawings) of the foldable jogging machine 10. The left slotted rail 12*c* and the right slotted rail 12*d* are fastened respectively to the left side 12*a* and the right side 12*b* by soldering and are parallel to each other.

The trotting platform 14 is formed of a plurality of metal tubular members by soldering and is provided with a front side 14*a*, a rear side 14*b*, a left side 14*c*, a right side 14*d*, and a trotting belt (not shown in the drawings) which is disposed between the left side 14*c* and the right side 14*d*. The front side 14*a* is provided with a carrying plate 14*e* fastened therewith for mounting thereon a motor or electrical element (not shown in the drawings) for use in driving the trotting belt.

The support device 16 comprises a left support rod 20, a right support rod 22, a cross rod 24 connecting the left support rod 20 and the right support rod 22, a left connection rod 26, and a right connection rod 28. The left and the right support rods 20 and 22 are respectively provided at one end with a roller 20*a*, 22*a* pivoted thereto.

Figure 4:
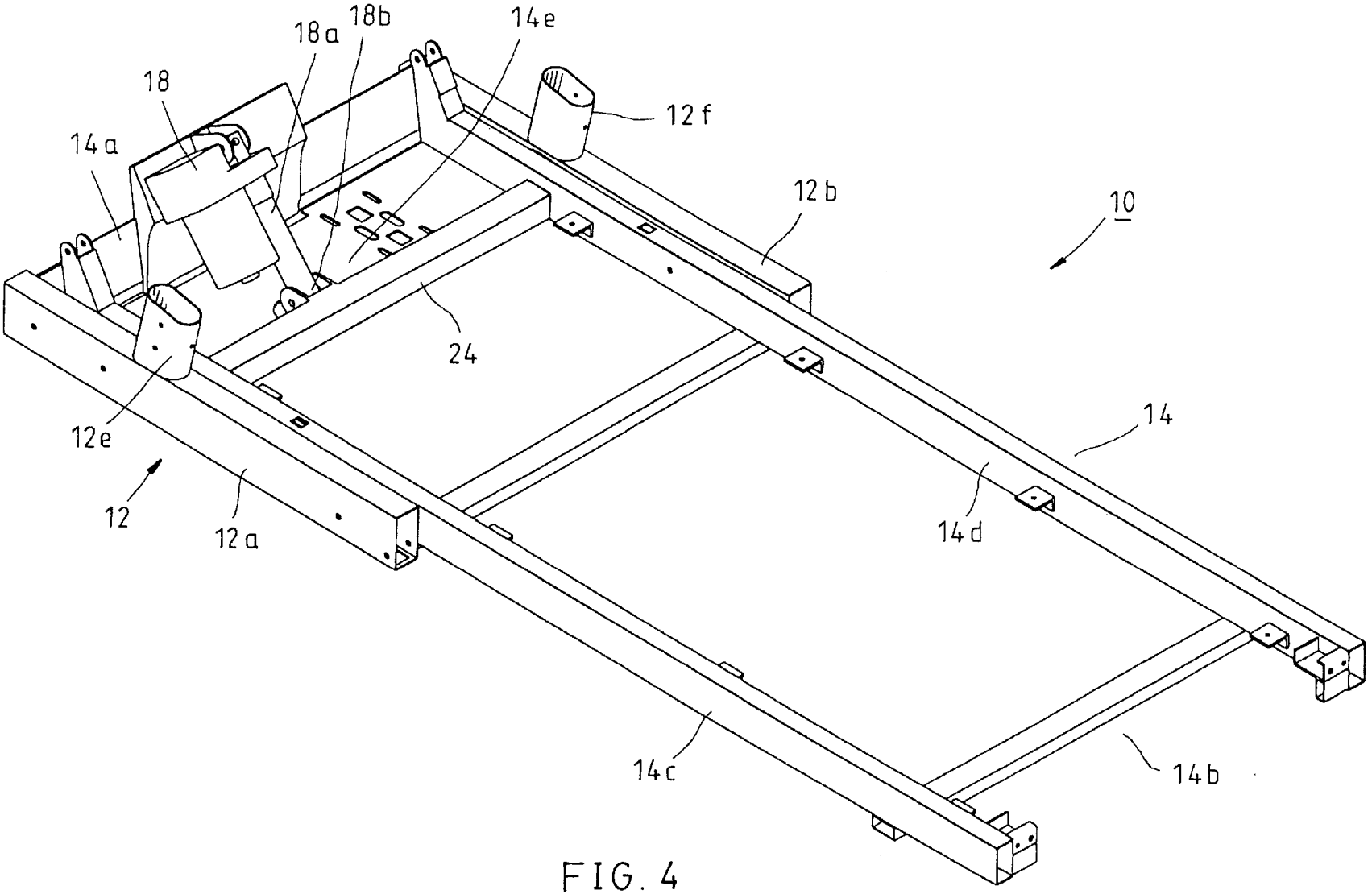
FIG. 4 shows a perspective view of the present invention with the trotting platform thereof being set in a horizontal position.
Figure 5:
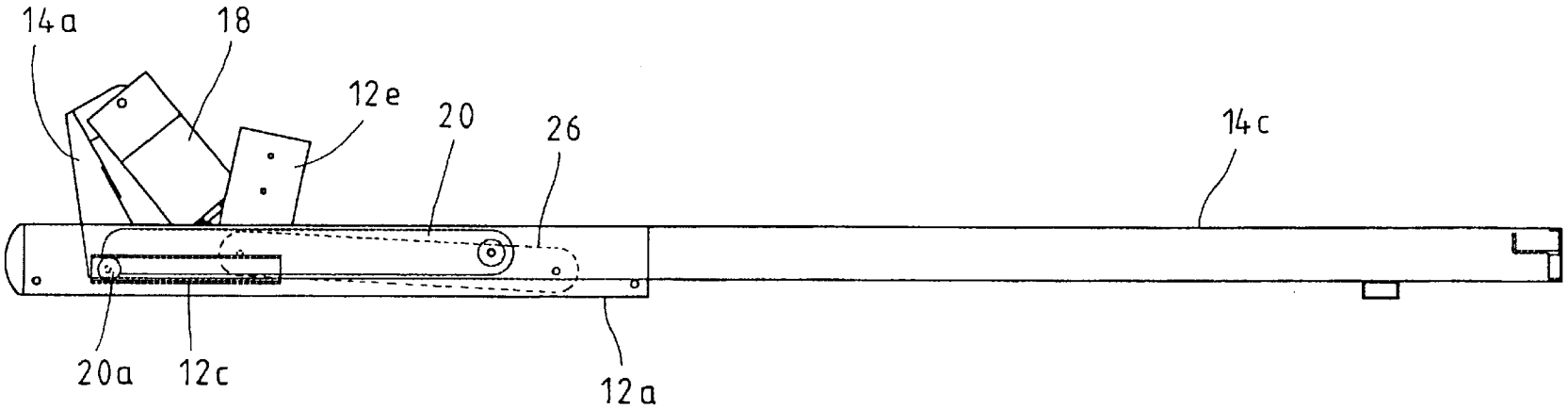
FIG. 5 shows a side view of the present invention as shown in FIG. 4.
Figure 6:
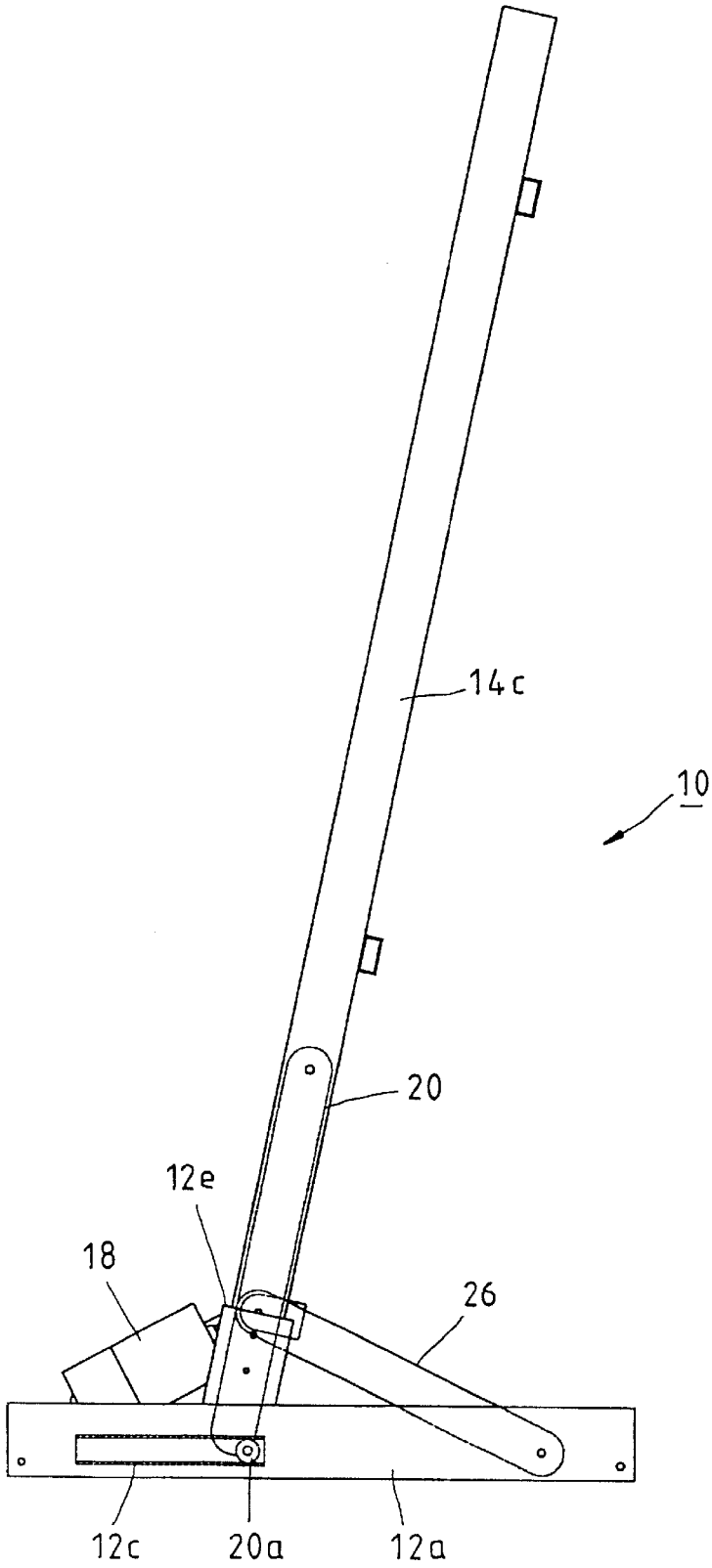
FIG. 6 shows a side view of the present invention in an unfolded state.

The rollers 20*a* and 22*a* are slidably disposed in the left and the right slotted rails 12*c* and 12*d*, thereby enabling one end of the left and the right support rods 20 and 22 to slide along the left and the right slotted rails 12*c* and 12*d*. The left and the right support rods 20 and 22 are fastened pivotally at other end thereof with the left side 14*c* and the right side 14*d* of the trotting platform 14. The left and the right connection rods 26 and 28 are pivotally fastened at one end thereof with the left side 12*a* and the right side 12*b* of the base 12, and at other end thereof with the midsegment of the left support rod 20 and the midsegment of the right support rod 22. The trotting platform 14 is thus connected to the base 12 by the support device 16 in such a manner that the trotting platform 14 can be set in a folded position as shown in FIGS. 4 and 5, and an unfolded position as shown in FIG. 6. In other words, the trotting platform 14 of the present invention can be erected to facilitate the storage of the jogging machine 10.

The linear actuator 18 of the preferred embodiment of the present invention is an electrical actuator, which is fastened with the carrying plate 14*e* of the trotting platform 14 and is provided with an expandable rod 18*a*. The expandable rod 18*a* is pivotally fastened at the free end 18*b* thereof with the cross rod 24 of the support device 16. A conventional oil pressure cylinder or air pressure cylinder may be used in place of the electrical actuator 18.

In light of the trotting platform 14 of the jogging machine 10 of the present invention being fastened with the base 12 by the support device 16 in such a way that the trotting platform 14 is close to the floor surface on which the base 12 is rested, the jogging machine 10 has a center of gravity, which is close to the floor surface. For this reason, the jogging machine 10 in operation is stable and is not susceptible to vacillation.

As shown in FIG. 6, the trotting platform 14 of the foldable jogging machine 10 of the present invention is erected such that the rollers 20*a* and 22*a* of the left support rod 20 and the right support rod 22 are located respectively at the rear end of the left slotted rail 12*c* and the right slotted rail 12*d*. As a result, the left and the right connection rods 26 and 28, the left and the right support rods 20 and 22, and the expandable rod 18*a* of the linear actuator 18 form together a triangular support structure by which the erected platform 14 is held securely. By erecting the trotting platform 14, the jogging machine 10 of the present invention takes up a relatively small floor space of the storage room.

Figure 2:
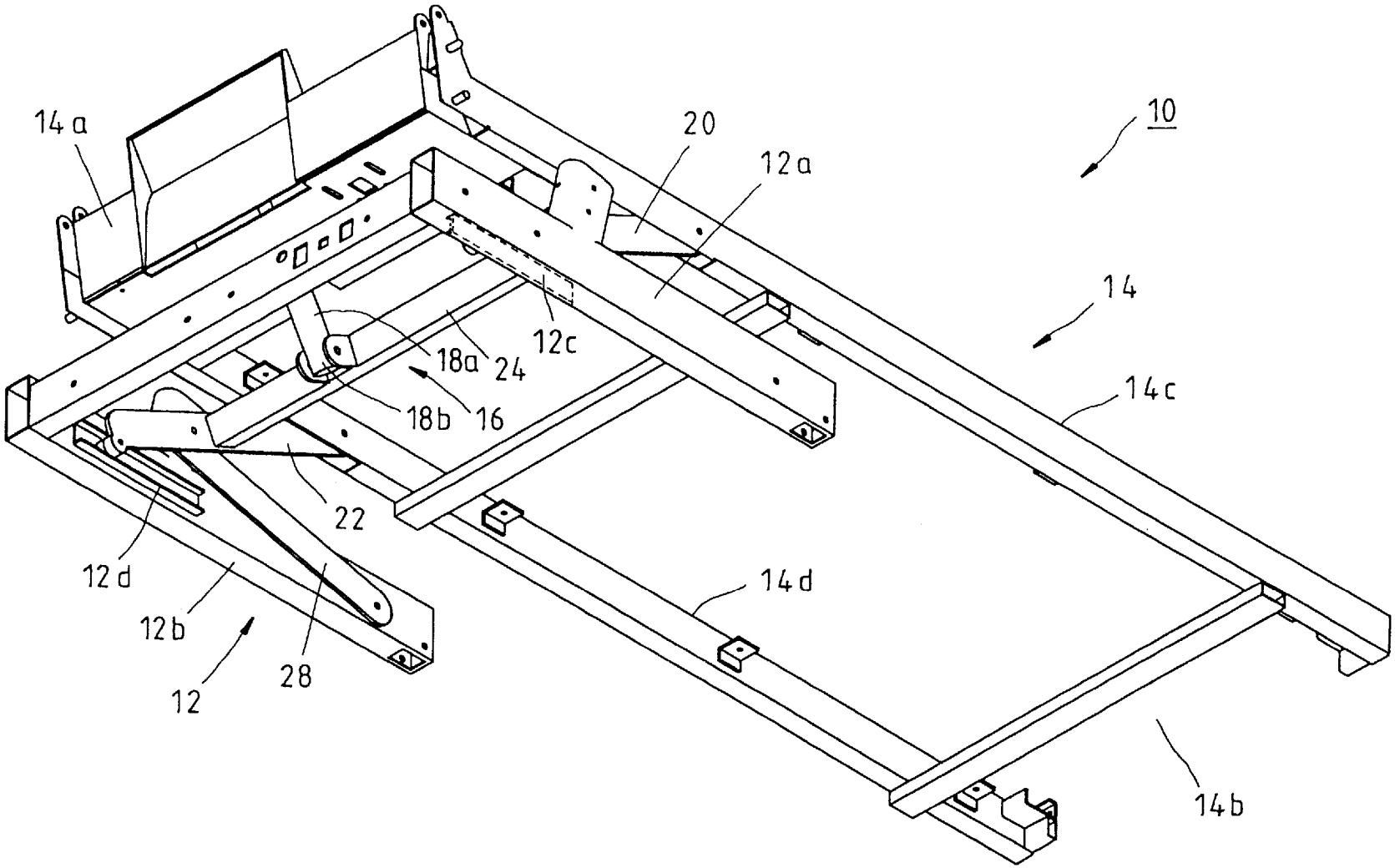
FIG. 2 shows another perspective view of the present invention with the trotting platform thereof being set in an inclined position.
Figure 3:
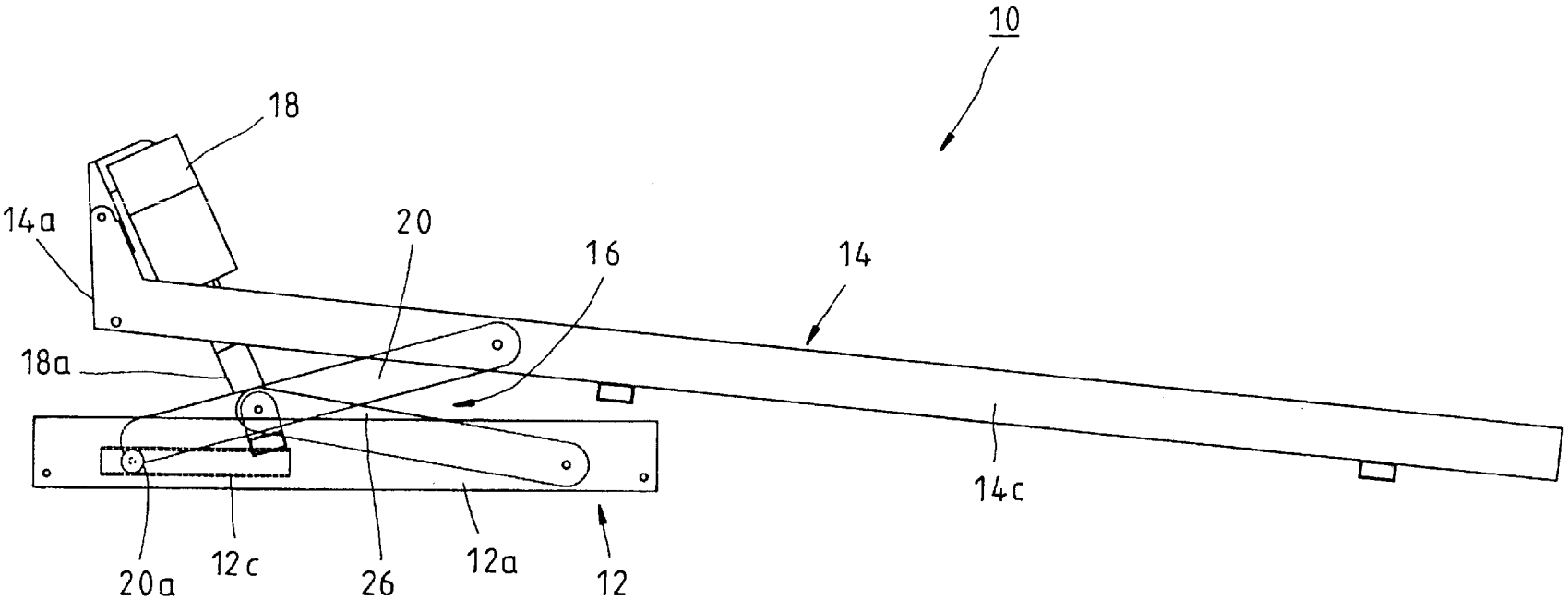
FIG. 3 shows a side view of the present invention with the trotting platform thereof being set in an inclined position.

As illustrated in FIGS. 1–3, the trotting platform 14 of the jogging machine 10 is so inclined as to enable a user of the machine 10 to emulate an uphill jogging. The expandable rod 18*a* of the linear actuator 18 is caused by a control device (not shown in the drawings) to extract to push the cross rod 24 of the support device 16, thereby forcing the rollers 20*a* and 22*a* of the left and the right support rods 20 and 22 to slide toward the rear ends of the left slotted rail 12*c* and the right slotted rail 12*d*. As a result, the front side 14*b* of the trotting machine 14 is raised.

As shown in FIGS. 4 and 5, the trotting platform 14 is set in a horizontal position by using the control device to retract completely the expandable rod 18*a* of the linear actuator 18, thereby forcing the rollers 20*a* and 22*a* of the left and the right support rods 20 and 22 to slide toward the front ends of the left slotted rail 12*c* and the right slotted rail 12*d*.

What is claimed is:

1. A foldable jogging machine comprising:

a base rested on the floor surface and formed on a left side having a left slotted rail, and a right side having a right slotted rail;

a trotting platform having a front side, a rear side, a left side, and a right side;

adjustment means engaged between the base and the trotting platform for moving the trotting platform from a coplanar position with the base to a spaced apart and inclined position above the base wherein the trotting platform can be used;

said adjustment means comprising a left support and a right support rod, such that one end of said left support rod is slidably disposed in said left slotted rail of said base, and that one end of said right support rod is slidably disposed in said right slotted rail of said base; and a linear actuator provided with an expandable rod and fastened with said trotting platform such that said expandable rod is pivotally fastened at a free end thereof with the adjustment means so as to actuate said one end of said left support rod to slide along said left slotted rail of said base and said one end of said right support rod to slide along said right slotted rail of said base.

2. The foldable jogging machine as defined in claim 1, wherein said adjustment means further comprises a left connection rod and a right connection rod whereby said left connection rod and said right connection rod are pivotally fastened at one end thereof with said left side and said right side of said base, and at other end thereof with said left support rod and said right support rod, said left support rod and said right support rod being fastened pivotally at other end thereof with said left side and said right side of said trotting platform.

3. The foldable jogging machine as defined in claim 2, wherein said adjustment means further comprises a cross rod whereby said cross rod connects said left support rod and said right support rod; and wherein said free end of said expandable of said linear actuator is pivotally fastened with said cross rod.

4. The foldable jogging machine as defined in claim 1, wherein said one end of said left support rod is provided with a roller pivoted thereto such that said roller is slidably disposed in said left slotted rail; and wherein said one end of said right support rod is provided with a roller pivoted thereto such that said roller is slidably disposed in said right slotted rail.

* * * * *